United States Patent [19]

Yoshida et al.

[11] Patent Number: 5,038,181

[45] Date of Patent: Aug. 6, 1991

[54] IMAGE FORMING UNIT HAVING MEANS FOR PREVENTING A CLEANSING BLADE FROM CONTACTING AN IMAGE HOLDING MEMBER UNTIL IMAGE FORMING UNIT IS USED

[75] Inventors: Narutaka Yoshida, Osaka; Kiyoshi Hirose, Kyoto, both of Japan

[73] Assignee: Minolta Camera Kabushiki Kaisha, Osaka, Japan

[21] Appl. No.: 426,117

[22] Filed: Oct. 24, 1989

[30] Foreign Application Priority Data

Oct. 31, 1988 [JP] Japan ..... 63-275274

[51] Int. Cl.[5] ..... G03G 21/00; G03G 13/00

[52] U.S. Cl. ..... 355/299; 355/210; 355/296

[58] Field of Search ..... 355/296, 299, 200, 210

[56] References Cited

U.S. PATENT DOCUMENTS

| | | | |
|---|---|---|---|
| 4,284,345 | 8/1981 | Takashi et al. | 355/299 |
| 4,602,864 | 7/1986 | Kimura et al. | 355/299 |
| 4,639,122 | 1/1987 | Pease | 355/299 |
| 4,640,608 | 2/1987 | Higaya et al. | 355/299 |
| 4,791,454 | 12/1988 | Takahashi et al. | 355/299 |
| 4,891,676 | 2/1990 | Davis et al. | 355/271 |

FOREIGN PATENT DOCUMENTS

| | | | |
|---|---|---|---|
| 0141675 | 9/1982 | Japan | 355/299 |
| 58-82285 | 5/1983 | Japan . | |
| 0105670 | 6/1984 | Japan | 355/299 |
| 59-126251 | 8/1984 | Japan . | |

*Primary Examiner*—A. T. Grimley
*Assistant Examiner*—Nestor R. Ramirez
*Attorney, Agent, or Firm*—Willian, Brinks, Olds, Hofer, Gilson & Lione

[57] ABSTRACT

A blade for cleaning an image holding member of an image forming unit is urged so as to contact the image holding member, and a member for obstructing the blade from contacting the image holding member by urged strength is arranged to release the obstruction. The member is further arranged so as to regulate returning action to the state of obstruction after the obstruction is released. Accordingly, when the blade is released from the state of obstruction by the obstruction member, the blade comes in contact with the image holding member by the urged strength and afterward it is kept in the state of contact since the obstructing function of the obstruction member is regulated.

16 Claims, 4 Drawing Sheets

IMAGE FORMING UNIT HAVING MEANS FOR PREVENTING A CLEANSING BLADE FROM CONTACTING AN IMAGE HOLDING MEMBER UNTIL IMAGE FORMING UNIT IS USED

BACKGROUND OF THE INVENTION

1. Field of the Invention

The present invention relates to an image forming unit for use in an image forming apparatus, and more particularly, to an image forming unit which can be removably attached to an image forming apparatus such as copying machine and printer provided with a photoconductive drum, a cleaning device for the photoconductive drum and the like.

2. Description of Related Art

In recent years, in a small-sized personal type image forming apparatus, an image forming unit which is incorporated with photoconductive drum and other image forming devices such as developing unit, cleaning device and charger is removably used in consideration of reproducing a multi-colored image by one image forming apparatus with simple and convenient maintenance, wherein the image forming unit mounted in the image forming apparatus is abandoned when the developer accommodated in a developing unit is consumed, and a new image forming unit is mounted therein.

In order to cope with such a disposable type image forming unit, the image forming apparatus has to be provided with a spare image forming unit. However, the spare image forming unit is left unused for three months or nearly a year, for instance, when the unit is applied to an image forming apparatus which is not used often. In the conventional spare image forming unit, the blade of a cleaning device comes into continuous contact with the same portion of photoconductive surface of photoconductive drum for over a long period of time, and consequently, creep deformation is produced on that portion thereby losing roundness on the photoconductive surface in the transverse section of the photoconductive drum. The lubricant coated on the blade is stuck to the surface of the photoconductive drum to form a film thereon by which charging capacity of the photoconductive drum on that portion and attenuation characteristic are varied, and the blade is deformed by the pressing contact with the drum in the long period of time.

Published Unexamined Utility Model Application 126251/1984 discloses an image forming unit which is capable of solving the problem, wherein the image forming unit is used for a divisible type image forming apparatus whose main body is divided into upper and lower portions. The blade of a cleaning device which is provided in the image forming unit is connected with a working member which is moved correlatively with opening and closing action of the upper unit relative to the lower unit. The working member presses the blade to come in contact with the photoconductive surface of the photoconductive drum correlatively with closing movement of the upper unit on which the image forming unit is mounted and is also activated to move the blade away from the photoconductive drum correlatively with the opening movement of the upper unit relative to the lower unit.

Accordingly, when the image forming unit is not mounted on the image forming apparatus and when the upper unit is not closed relative to the lower unit, the blade is held in a state away from the photoconductive surface of the photoconductive drum thus solving the problem which is caused by an unused state of the image forming unit over a long period of time. When the image forming unit is mounted on the image forming apparatus and the upper unit is closed, the blade is pressed to come in contact with the photoconductive surface of the photoconductor so that the surface of the drum can be cleaned. Further, the blade is separated from the photoconductive drum when the upper unit is opened relative to the lower unit.

However, in a method of separating the blade of the image forming unit from the photoconductive drum correlatively with the opening and closing movement of the upper unit relative to the lower unit, the working member is only moved for opening and closing action of the upper unit relative to the lower unit and the working member itself is comparatively strongly urged by a spring in order for the blade to properly come into contact with or separate away from the photoconductive drum by the correlative movement, and the working member is connected with the blade by the spring. In a type of apparatus wherein a blade is moved either to the position to come in contact with the photoconductive drum or to the position away from the drum correlatively with the opening and closing movement of the upper unit relative to the lower unit, when the image forming unit is attached or detached for maintenance and the photoconductive drum is attached or detached from the image forming unit, it can protect the photoconductive drum from getting scratched which occurs by contact with the blade when the drum is attached or detached. However, in case of the disposable type image forming unit, the number of labors and parts are wastefully increased to unnecessarily raise the manufacturing cost.

SUMMARY OF THE INVENTION

A primary object of the present invention is to provide an image forming unit for use in an image forming apparatus which is capable of solving the above-mentioned problem wherein a blade which is urged by a spring so as to come in pressing contact with a photoconductive drum is adopted, and the blade is retained at the position away from the photoconductive drum when the image forming unit is not in use, and when the image forming unit is put in a state of operation, the retained state is automatically released. The photoconductive drum is thus protected from the cleaning blade with a simple and inexpensive mechanism when the image forming unit is left unused for over a long period of time.

Another object of the present invention is to provide an image forming unit for use in an image forming apparatus which is capable of preventing troubles which might occur by unprepared and improper return to the state where the unit is not in use once the blade is pressed in contact with the photoconductive drum, wherein when the retaining member for retaining the blade at the position away from the drum is released and the blade is put at the position in contact with the photoconductive drum, the retaining member is obstructed from returning to the retaining position and the blade is kept in contact with the drum.

These and other objects and features of the present invention will become more apparent from the following description taken in conjunction with the accompanying drawings which illustrate specific embodiments of the present invention.

BRIEF DESCRIPTION OF THE DRAWING

It is to be noted that like parts are designated by like reference numerals and marks throughout each embodiment of the present invention and repeated description is omitted.

DESCRIPTION OF THE PREFERRED EMBODIMENT

Embodiments of the present invention will now be described below referring to accompanying drawings.

Figure 1:
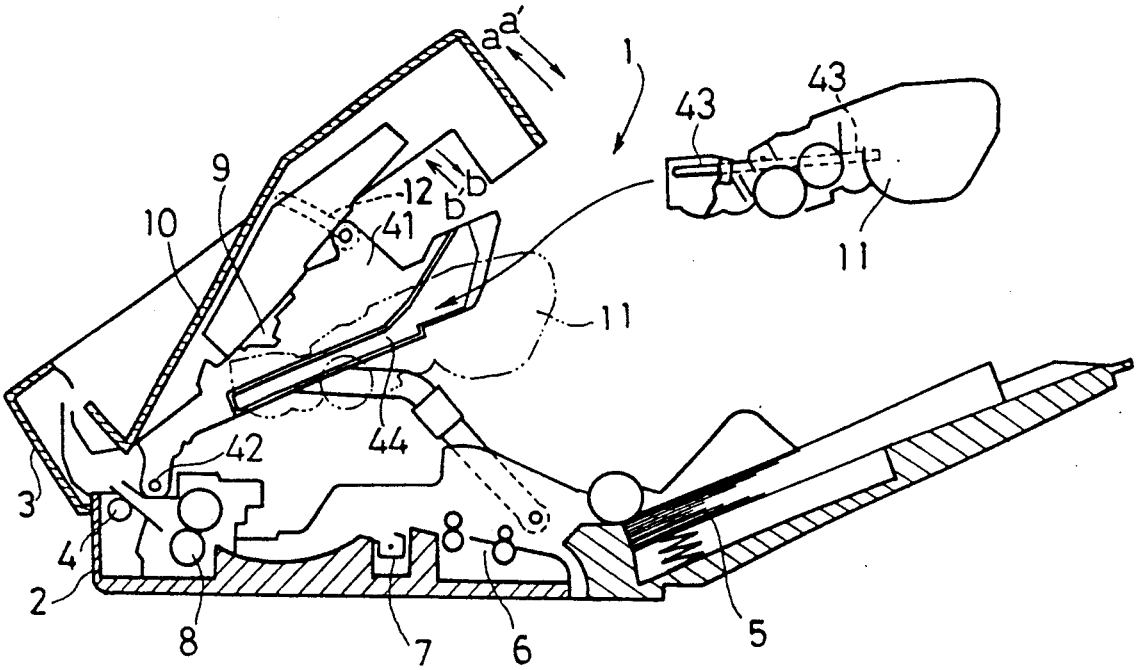
FIG. 1 is a cross-sectional view of a printer to which an image forming unit of the present invention is applied.
Figure 2:
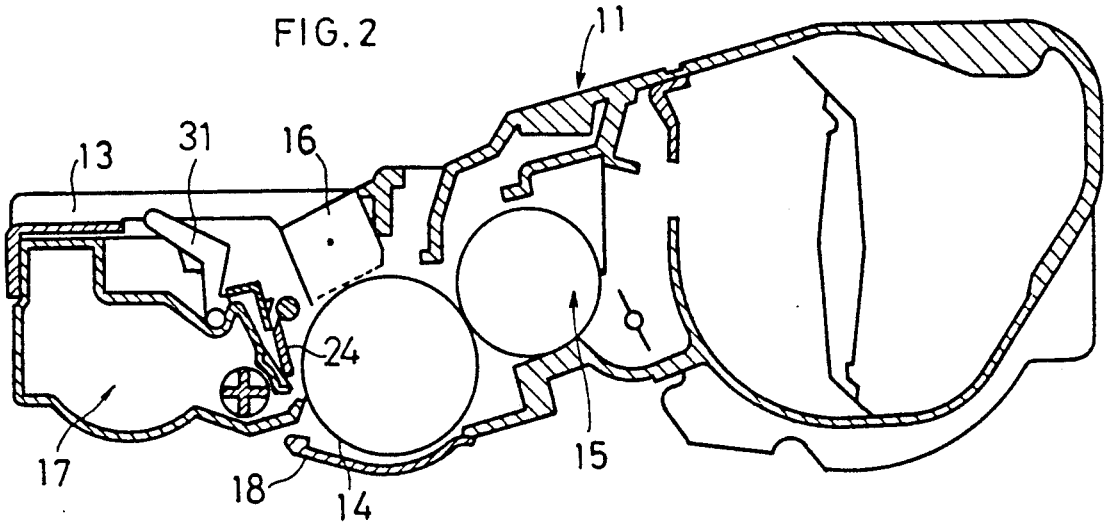
FIG. 2 is a cross-sectional view of an image forming unit showing an embodiment to which the present invention is applied.

FIGS. 1 through 6 show a first embodiment of the present invention. FIG. 1 shows a printer 1 in which an image forming unit 11 of the present invention shown in FIG. 2 is used. The printer 1 is a type vertically divisible into two units comprising a lower unit 2 and an upper unit 3 which is connected by a shaft 4 so as to be freely opened and closed in the vertical direction as shown by the arrows a,a'. In the lower unit 2, there are provided a paper feed device 5, a transport device 6, a transfer charger 7 and a fixing unit 8, while in the upper unit 3, an optical system 9 and a discharge tray 10 are provided with an arrangement for freely removably mounting the image forming unit 11 thereon.

In order to perform the attaching and detaching action of the unit 11, holding frames 41 of the image forming unit 11 are pivotally disposed movable upwardly and downwardly about a shaft 42 on both sides of the upper unit 3. At an inner surface of each holding frame 41, there are provided guide rails 44 for removably holding the image forming unit 11 by removably receiving projected portions 43 arranged on both sides of the image forming unit 11, and the image forming unit 11 can be removed without any interference with others at the position where an opened upper unit 3 is moved downward as shown by the phantom and solid lines in FIG. 1.

As shown in FIG. 2, a photoconductive drum 14, a developing unit 15, a charger 16 and a cleaning device 17 are integrally supported between a pair of side walls 13,13 facing each other (only one side is shown in FIG. 2) to form the image forming unit 11. The undersurface of the photoconductive drum 14 is protected by a protective plate 18 which can be freely opened and closed.

Figure 3:
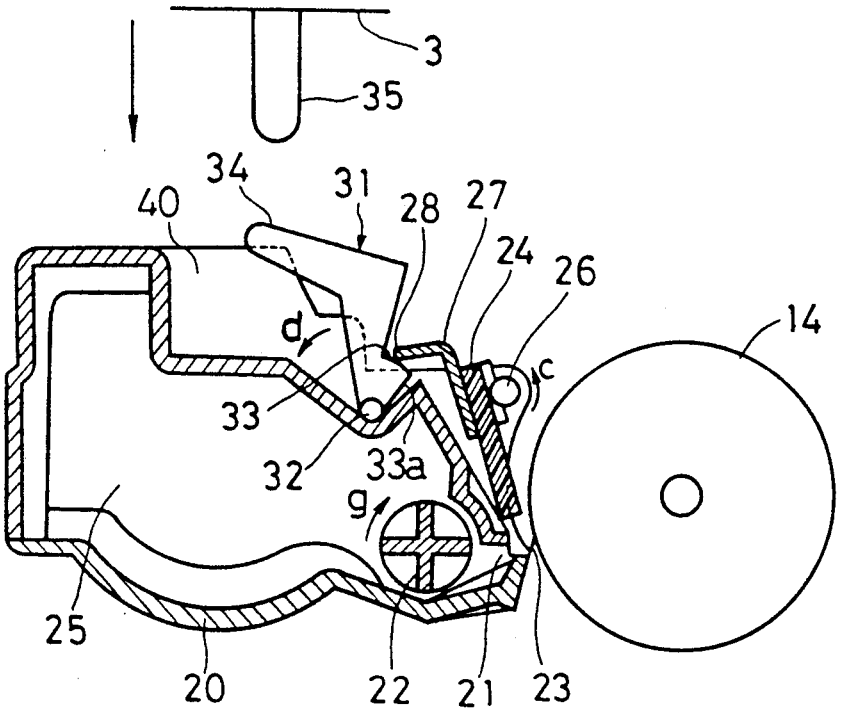
FIGS. 3 and 4 are cross-sectional and perspective views showing the state of a cleaning device in an image forming unit before it is used.

The cleaning device 17 is, as shown in FIG. 3, provided with a container 20 having an opening 21 opposite to the photoconductive drum 14, and inside the opening 21, there is rotatably arranged a collecting vane 22. At the opposite position to the photoconductive drum 14 in the container 20, an overflow preventive plate 23 is provided thereunder with a blade 24 arranged above. The overflow preventive plate 23 is stuck to an under frame of the container 20 and the edge of the plate is kept in contact with the photoconductive surface of the photoconductive drum 14.

The blade 24 is held by a support member 27 rotatably supported on side walls 25,25 (FIG. 4) of the container through a shaft 26, and the tip of the blade 24 is separably arranged in relation to the photoconductive drum 14.

Figure 4:
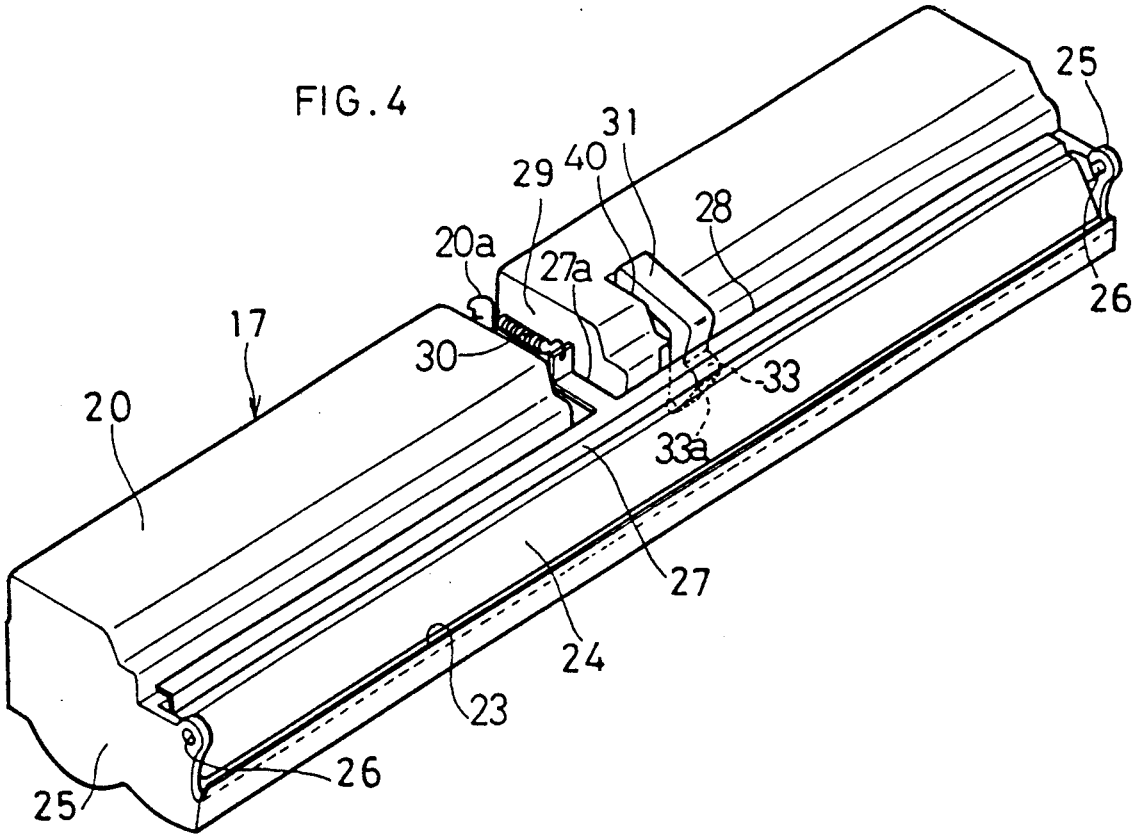
Figure 5:
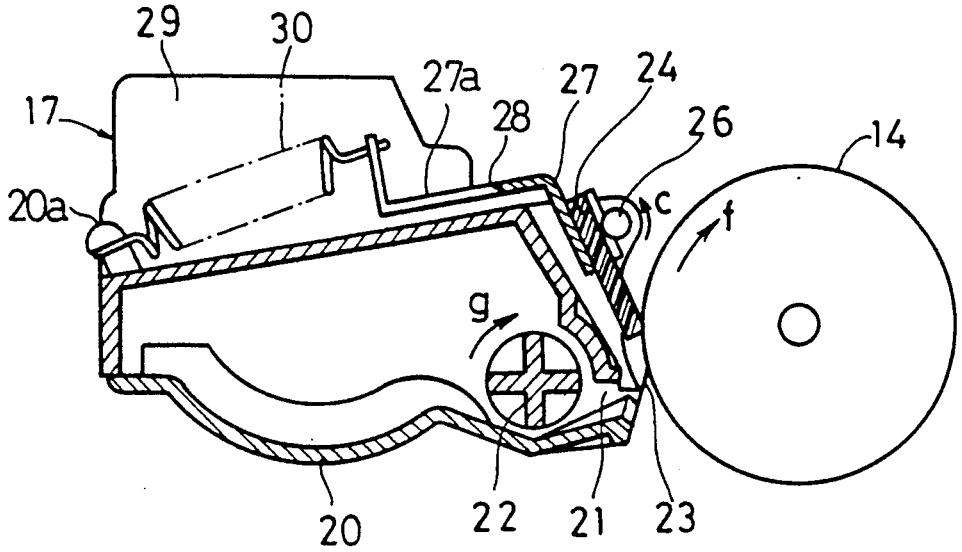
FIGS. 5 and 6 are cross-sectional views showing different positions of the cleaning device when it is in use.

As shown in FIGS. 4 and 5, the support member 27 has a projected piece 27*a* extending backward (lefthand side in the Figure) along a groove 29 formed longitudinally at almost the central portion on the upper surface of the container 20, and a spring 30 is activated between the back end portion and a protrusion 20*a* arranged at the rear portion of the groove 29 of the cleaning device 17, by which the support member 27 and the blade 24 are urged in the direction shown by the arrow c about a shaft 26.

At a recess 40 arranged adjacent to the groove 29 opposite to the support member 27 on the upper surface of the container 20, a lever 31 for retaining the blade 24 against the spring 30 at the position away from the photoconductive drum 14 is disposed. The lever 31 is formed in L-shape as shown in FIG. 3, and the lower end of which is rotatably supported movable about a shaft 32 at the upper portion of the container 20. At the portion opposite to a back edge 28 of the support member 27, there is provided a circular arc shaped stopper portion 33 for retaining the lever 31 at the position away from the photoconductive drum 14. The surface of the stopper portion 33 on the side of the support member 27 is made as a regulating surface 33a to obstruct the lever 31 returning to the retaining position by the blade 24 which is in contact with the back edge 28 of the support member.

At a state before the image forming unit 11 is mounted on the upper unit 3 for the first time, in other words, at a state when the unit has just been delivered from a factory, the stopper portion 33 of the lever 31 is made at a retained state to receive the back edge 28 of the support member 27, and the blade 24 is obstructed from getting into pressing contact with the photoconductive drum 14 by the spring 30. At this time, the back edge 28 of the support member 27 is pressed to contact the stopper portion 33 by the spring 30 thereby stabilizing the lever 31 at the retaining position. Accordingly, the lever 31 is prevented from moving from the retaining position inadvertently when the image forming unit 11 is stored or when it is carried. The lever 31 is arranged in the recess 40 in order to hardly receive external force which also helps to prevent the movement.

In the image forming unit 11 provided with the mechanism as described above, when the unit is mounted on the frame 41 moved downwardly from the upper unit 3 opened relative to the lower unit 2 as shown by the phantom line in FIG. 1, the unit is rotatably held with the support frame 41 movable about the shaft 42 in the direction of b,b' in relation to the upper unit 3. Under this state, when the upper unit 3 is moved downwardly toward the lower unit 2, a protective plate 18 is opened to expose the undersurface of the photoconductive drum 14, and the image forming unit 11 comes in contact with the lower unit 2 and is moved in the direction shown by the arrow b' relative to the upper unit 3 being further moved downward. And, as shown in FIG. 3, the protrusion 35 provided on the upper unit 3 approaches the image forming unit 11 to press the free end side 34 of the lever 31.

Figure 6:
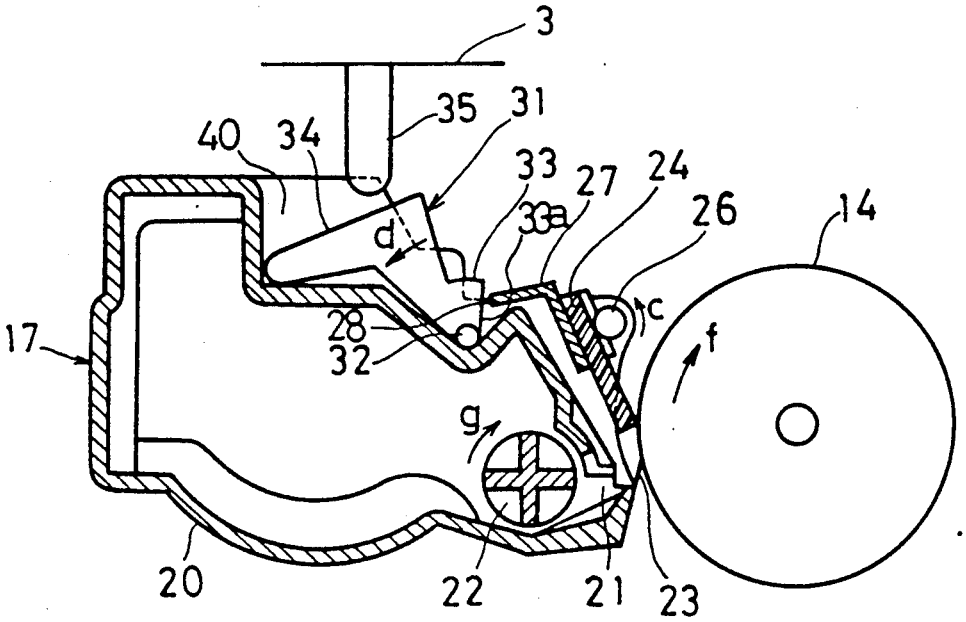

The lever 31 is thus rotated in the direction of arrow d about the shaft 32, and the engagement of the back edge 28 of the support member 27 with the stopper portion 33 of the lever 31 is released. Accordingly, the support member 27 is moved in the direction shown by the arrow c by the spring 30, and the tip of the blade 24 comes in contact with the photoconductive surface of the photoconductive drum 14 to be ready for cleaning operation as shown in FIG. 6. The blade 24 is pressed to contact the photoconductive drum 14 only when the upper unit 3 is closed relative to the lower unit 2 so that there will no possibility of causing deformation or characteristic change on the photoconductive drum 14 and the blade 24 even if the image forming unit 11 is left unused for over a long period of time.

The residual toner, paper dust and the like stuck to the photoconductive drum 14 during an image forming process by the printer 1 are scraped with the blade 24 by rotation of the photoconductive drum 14 in the direction of the arrow f. The scraped toner, paper dust and the like flows into the container 20 through the opening 21 by guidance of the overflow preventive plate 23 without dropping into the gap between the photoconductive drum 14 and the cleaning device 17, and they are collected inside the container 20 by the collecting vane 22.

In case when a transfer sheet is jammed during an image forming operation, the upper unit 3 in which the image forming unit 11 is mounted is opened relative to the lower unit 2 by which the paper feed path is opened and the trouble of paper jam is cleared. When the upper unit 3 is opened, the image forming unit 11 is rotated correlatively in the direction shown by the arrow b relative to the upper unit 3 to become in the state as shown in FIG. 1. At this stage, the protrusion 35 of the upper unit 3 is separated from the lever 31 of the image forming unit. However, once the image forming unit 11 is put in use, the regulating surface 33*a* of the lever 31 is positioned opposite to and adjacent to the back edge 28 of the support member 27 of the blade 24 being put in use as shown in FIG. 6. Accordingly, even if the lever 31 is inadvertently caused to move back to the retaining position for some reason, the regulating surface 33*a* comes in contact with the back edge 28 of the support member 27 to obstruct the movement. In effect, the image forming unit 11 does not return to an unused state without resorting to a manual operation of returning the lever 31 to the retaining position after the support member 27 is manually raised against the spring 30.

Accordingly, even if the protrusion is separated from the lever by opening the upper unit 3, the blade 24 is kept in contact with the photoconductive drum 14 and there is no possibility of dispersing the collected toner in the container 20 by the opening and closing action of the upper unit 3. The trouble which might occur by inadvertently and improperly returning to an unused state is solved. However, it can be put to the unused state according to requirement. As a matter of fact, the toner is not accommodated in the image forming unit 11 when it is prepared as a spare unit, and therefore, there is no possibility of dispersing toner even if the blade 24 is separated from the photoconductive drum 14.

Once the image forming unit 11 is put in use, the blade 24 can not be separated from the photoconductive drum 14 unless it is moved manually since there is nothing to support the blade 24 at the unused position. Accordingly, the expected object can be accomplished with very simple mechanism.

In the embodiment described above, the image forming unit 11 is pivotally supported on the upper unit 3, and by closing the upper unit 3 to the lower unit 2, the free end portion 34 of the lever 31 is moved downward by the protrusion 35 arranged on the upper unit 3 to press the blade 24 in contact with the photoconductive drum 14. However, the image forming unit 11 may be adapted to be inserted from the side of the upper unit 3. In this case, the lever 31 is arranged to be moved downward correlatively with the inserting action of the image forming unit 11.

In the above described embodiment, description is made only on the cleaning process by use of a blade, however, it may be arranged to utilize fur brush, rope and web. Any kind of cleaning member which can contact the photoconductive drum may be applied to the present invention. The photoconductor is not limited to the drum type and there is no restriction on the type of photoconductor.

The present invention has been particularly shown and described in connection with a printer, and it is to be understood that the application of the image forming unit of the invention is not limited to a printer. As another application of the image forming unit of the present invention, mention may be made of, for example, a copying machine, output of facsimile equipment or computer.

Figure 7:
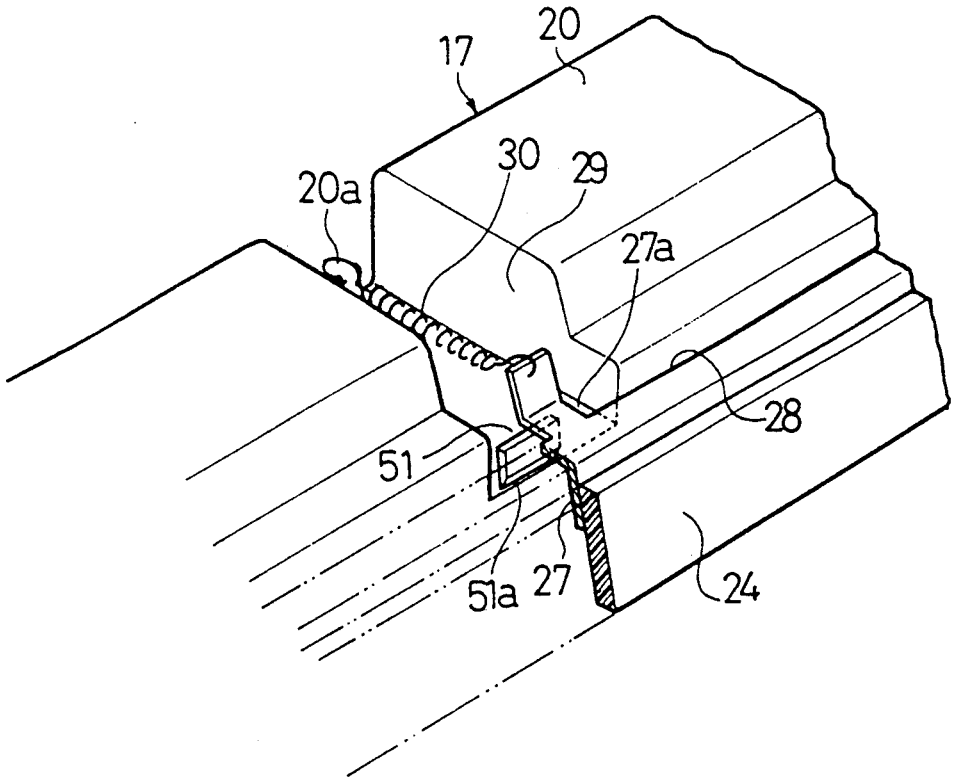
FIG. 7 is a view, partially in perspective, of the cleaning device showing another embodiment of the present invention.

Description will now be made of a second embodiment of the present invention with reference to FIG. 7.

As illustrated in the FIG., in this embodiment there is provided a stopper 51 by utilizing a groove 29 formed on the upper surface of the container 20. The stopper 51 is a plate portion integrally formed upwardly on the bottom of the groove 29. The stopper 51 is arranged at a position facing a projected piece 27*a* of a support member 27 from the lower side and stopping the projected piece 27*a* which is urged downwardly by a spring 30. The support member 27 is thereby engaged so as to stabilize a blade 24 at a non-operating position.

A cutting groove 51*a* is formed on one side of the bottom portion of the stopper 51. The stopper 51 is easily folded and removed at the portion of cutting groove 51*a*. Practically, the stopper 51 may be folded and removed by pressing it from one side with the tip of a finger of the operator or with a proper hand tool. The support member 27 is disengaged by removal of the stopper 51, and the blade 24 is put in an operating state by the energy of the spring 30. Thereafter the support member 27 is not engaged again.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming unit which can be removably mounted on the main body of an image forming apparatus, comprising:

an image holding member for holding an image developed by toner on its surface;

a cleaning means for scraping and removing a substance stuck to the surface of the image holding member when it contacts the image holding member;

a biasing means for pressing the cleaning means and the surface of the image holding member into contact with each other;

an obstruction means for obstructing the cleaning means and the surface of the image holding member from being pressed into contact with each other by the biasing means prior to initial use of the image forming unit;

means for releasing the obstruction means for causing said biasing means to press said cleaning means and said surface of the image holding member into contact with each other when the image forming unit is firstly mounted on the main body of the image forming apparatus; and preventing means for thereafter preventing said obstruction means from obstructing said cleaning means and said surface of said image holding member from contacting each other such that said cleaning means and said surface of said image holding member will thereafter be maintained pressed in contact with each other by said biasing means.

2. The image forming unit as defined in claim 1, wherein the image forming unit includes a developing means.

3. The image forming unit as defined in claim 1, wherein the image forming unit includes a means for accommodating developer removed from the surface of the image holding member by the cleaning means.

4. The image forming unit as defined in claim 1, wherein the cleaning means is comprised of a cleaning member which contacts the image holding member and a support member pivotally supporting the cleaning member.

5. The image forming unit as defined in claim 4, wherein the obstruction means includes a first portion for maintaining the cleaning means at a location away from the surface of the image holding member, and wherein said preventing means comprises a second portion on said obstruction means for preventing the cleaning means from returning to said location after the cleaning means has been released by said obstruction means.

6. The image forming unit as defined in claim 4, wherein the obstruction means cooperates with a part of the cleaning means to retain the cleaning means at a location away from the surface of the image holding member until the obstruction means is separated from the cleaning means.

7. An image forming apparatus having a main body and a support means for removably supporting against the main body an image forming unit which is provided with an image forming means; comprising:

the image forming unit comprising an image holding member for holding an image developed by toner on its surface, a cleaning means movably supported for movement toward and away from the surface of the image holding member to scrape and remove a substance stuck to the surface of the image holding member when it is contacted thereto, a biasing means for biasing the cleaning means so as to press the cleaning means into contact with the surface of the image holding member, and an obstruction means for obstructing the cleaning means from being pressed into contact with the surface of the image holding member against the strength of the biasing means prior to initial use of the image forming unit;

a releasing means for releasing the obstruction means to cause the cleaning means to be pressed into contact with the surface of the image holding member by the biasing means in response to an action of the image forming apparatus in which the image forming unit is mounted moving to a position relative to the main body where an image can be formed; and preventing means for thereafter preventing said obstruction means from obstructing said cleaning means from contacting said surface of said image holding member such that said cleaning means will thereafter be maintained pressed into contact with said surface of said image holding member by said biasing means.

8. The image forming apparatus as defined in claim 7, wherein the main body is provided with a frame consisting of upper and lower portions openably connected to each other and a guide means arranged on the upper portion of the frame to guide the image forming unit to a predetermined position of the main body.

9. The image forming apparatus as defined in claim 8, wherein the image forming unit includes a developing means.

10. The image forming apparatus as defined in claim 8, wherein the image forming unit includes a means for accommodating developer removed from the surface of the image holding member by the cleaning means.

11. The image forming apparatus as defined in claim 8, wherein the cleaning means is comprised of a cleaning member which contacts the image holding member and a support member pivotally supporting the cleaning member.

12. The image forming apparatus as defined in claim 11, wherein the obstruction means includes a first portion for maintaining the cleaning means at a location away from the surface of the image holding member, and wherein said preventing means includes a second portion on said obstruction means for preventing the cleaning means from returning to said location after the cleaning means has been released by said obstruction means.

13. The image forming apparatus as defined in claim 11, wherein the obstruction means cooperates with a part of the cleaning means to retain the cleaning means at a location away from the surface of the image holding member until the obstruction means is separated from the cleaning means.

14. An image forming unit which can be removably mounted on the main body of an image forming apparatus, comprising:

a blade which comes in contact with the surface of an image holding member, the blade having a leading end portion adapted to come in contact with the image holding member to scrape residual toner;

a blade supporting member pivotally disposed for fixedly supporting the blade;

a spring member for biasing the blade supporting member so as to cause the blade to come into contact with the surface of the image holding member; and a stopper member which is movably disposed from an operating position to a non-operating position only, the stopper member having a stopper portion which contacts the blade holding member and a non-operating portion which is pressed to operate from the outside of the image forming unit when the image forming unit is first mounted on the main body of the apparatus, the stopper member being positioned and firmly fixed at the operating position before the image forming unit is mounted on the main body of the apparatus by causing the stopper portion to come in contact with the blade supporting member, the movement of the blade supporting member being regulated so as to obstruct the blade from coming into contact with the surface of the image holding member when the stopper member is at the operating position, whereby when the image forming unit is first mounted on the main body of the apparatus, the non-operating portion of the stopper member is pressed to operate from the outside toward the inside of the image forming unit corresponding with a mounting action of the image forming unit, and, at this stage, the contact of the blade supporting member with the stopper portion is released and the stopper member is moved to the non-operating position, thereby indisposing the restriction of the movement of the blade supporting member by the stopper member, and the blade supporting member is moved by the energy of the spring member until the blade comes in contact with the surface of the image holding member, and the state of contact is maintained thereafter.

15. The image forming unit as defined in claim 14, wherein the stopper member is energized from the operating position to the non-operating position by its own weight.

16. The image forming unit as defined in claim 14, wherein the non-operating portion of the stopper member is pressed to operate by a pressing member disposed in the main body of the apparatus.

* * * * *

UNITED STATES PATENT AND TRADEMARK OFFICE

CERTIFICATE OF CORRECTION

PATENT NO. : 5,038,181

DATED : August 6, 1991

INVENTOR(S) : Narutaka Yoshida, et al.

It is certified that error appears in the above-identified patent and that said Letters Patent is hereby corrected as shown below:

In col. 8, lines 67-68 (claim 14, lines 17-18), change "a non-operating" to --an operated--.

In col. 9, line 15 (claim 14, line 33), change "non-operating" to --operated--.

In col. 10, line 16 (claim 16, line 2), change "non-operating" to --operated--.

Signed and Sealed this

Twenty-second Day of December, 1992

*Attest:*

DOUGLAS B. COMER

*Attesting Officer*

*Acting Commissioner of Patents and Trademarks*